US009121158B2

(12) United States Patent
Yamada

(10) Patent No.: US 9,121,158 B2
(45) Date of Patent: Sep. 1, 2015

(54) HYDRAULIC EXCAVATOR

(75) Inventor: Takeo Yamada, Komatsu (JP)

(73) Assignee: KOMATSU LTD., Tokyo (JP)

( * ) Notice: Subject to any disclaimer, the term of this patent is extended or adjusted under 35 U.S.C. 154(b) by 710 days.

(21) Appl. No.: 12/676,706

(22) PCT Filed: Sep. 29, 2008

(86) PCT No.: PCT/JP2008/067682

§ 371 (c)(1),
(2), (4) Date: Mar. 5, 2010

(87) PCT Pub. No.: WO2009/063700

PCT Pub. Date: May 22, 2009

(65) Prior Publication Data

US 2010/0235060 A1 Sep. 16, 2010

(30) Foreign Application Priority Data

Nov. 13, 2007 (JP) ..... 2007-294027

(51) Int. Cl.

| | |
|---|---|
| ***F02D 29/04*** | (2006.01) |
| ***E02F 9/22*** | (2006.01) |
| ***F02D 41/02*** | (2006.01) |
| ***F02D 41/14*** | (2006.01) |

(52) U.S. Cl.

CPC ..... *E02F 9/2246* (2013.01); *E02F 9/2292* (2013.01); *E02F 9/2296* (2013.01); *F02D 29/04* (2013.01); *F02D 41/021* (2013.01); *F02D 41/1497* (2013.01)

(58) Field of Classification Search

USPC ..... 701/50, 54

See application file for complete search history.

(56) References Cited

U.S. PATENT DOCUMENTS

| | | | | | |
|---|---|---|---|---|---|
| 4,779,591 | A | * | 10/1988 | Tordenmalm | 123/352 |
| 4,796,466 | A | * | 1/1989 | Farmer | 73/40.5 R |
| 5,018,061 | A | * | 5/1991 | Kishigami et al. | 711/3 |
| 5,046,353 | A | * | 9/1991 | Thompson | 73/40.7 |
| 5,249,422 | A | * | 10/1993 | Smith et al. | 60/426 |
| 5,416,724 | A | * | 5/1995 | Savic | 702/51 |
| 5,784,540 | A | * | 7/1998 | Faltings | 706/46 |
| 5,825,003 | A | * | 10/1998 | Jennings et al. | 235/379 |
| 5,883,815 | A | * | 3/1999 | Drakulich et al. | 702/51 |
| 6,008,808 | A | * | 12/1999 | Almeida et al. | 715/767 |
| 6,047,281 | A | * | 4/2000 | Wilson et al. | 1/1 |
| 6,161,522 | A | * | 12/2000 | Fuchita et al. | 123/385 |

(Continued)

FOREIGN PATENT DOCUMENTS

| | | | |
|---|---|---|---|
| JP | 07-127493 | A | 5/1995 |
| JP | 10-205368 | A | 8/1998 |

(Continued)

*Primary Examiner* — Rami Khatib
*Assistant Examiner* — Jean-Paul Cass
(74) *Attorney, Agent, or Firm* — Global IP Counselors, LLP

(57) ABSTRACT

An engine control device is adapted to be used for a construction machine equipped with an engine, a hydraulic pump to be driven by the engine, a revolving motor for revolving an upper structure by means of hydraulic oil to be supplied from the hydraulic pump, and a revolving operation lever for executing an operation of revolving the upper structure. The engine control device includes an operation amount detection unit configured to detect an operation amount of the revolving operation lever, and a control unit configured to increase a maximum engine speed when a result of detection by the operation amount detection unit is greater than a predetermined threshold.

10 Claims, 6 Drawing Sheets

(56) References Cited

U.S. PATENT DOCUMENTS

| | | | | |
|---|---|---|---|---|
| 6,177,860 | B1 * | 1/2001 | Cromer et al. | 340/10.1 |
| 6,243,483 | B1 * | 6/2001 | Petrou et al. | 382/103 |
| 6,359,434 | B1 * | 3/2002 | Winslow et al. | 324/220 |
| 6,429,016 | B1 * | 8/2002 | McNeil | 436/47 |
| 6,574,561 | B2 * | 6/2003 | Alexander et al. | 702/5 |
| 6,683,614 | B2 * | 1/2004 | Walls et al. | 345/506 |
| 6,704,638 | B2 * | 3/2004 | Livshiz et al. | 701/102 |
| 6,738,628 | B1 * | 5/2004 | McCall et al. | 455/456.1 |
| 6,745,117 | B1 * | 6/2004 | Thacher et al. | 701/50 |
| 6,920,618 | B2 * | 7/2005 | Walls et al. | 715/840 |
| 7,027,046 | B2 * | 4/2006 | Zhang | 345/419 |
| 7,027,924 | B2 * | 4/2006 | Spoonhower et al. | 702/8 |
| 7,104,347 | B2 * | 9/2006 | Severinsky et al. | 180/65.23 |
| 7,161,489 | B2 * | 1/2007 | Sullivan et al. | 340/572.4 |
| 7,180,422 | B2 * | 2/2007 | Milenkovic et al. | 340/572.4 |
| 7,242,303 | B2 * | 7/2007 | Patel et al. | 340/572.4 |
| 7,251,236 | B1 * | 7/2007 | Cook | 370/338 |
| 7,359,931 | B2 * | 4/2008 | Tarabzouni et al. | 709/200 |
| 7,389,181 | B2 * | 6/2008 | Meadow et al. | 701/522 |
| 7,400,251 | B2 * | 7/2008 | Czyszczewski et al. | 340/572.1 |
| 7,418,491 | B2 * | 8/2008 | Childress et al. | 709/223 |
| 7,420,467 | B2 * | 9/2008 | Patenaude et al. | 340/572.1 |
| 7,533,527 | B2 * | 5/2009 | Naruse | 60/433 |
| 7,651,440 | B2 * | 1/2010 | Runde | 477/143 |
| 7,664,586 | B2 * | 2/2010 | Ozawa et al. | 701/50 |
| 7,761,496 | B2 * | 7/2010 | Tarabzouni et al. | 709/200 |
| 7,778,757 | B2 * | 8/2010 | Brattberg | 701/51 |
| 7,779,616 | B2 * | 8/2010 | Sheidler et al. | 56/1 |
| 7,788,889 | B2 * | 9/2010 | Sheidler | 56/10.7 |
| 7,856,301 | B2 * | 12/2010 | Sjogren et al. | 701/50 |
| 8,014,308 | B2 * | 9/2011 | Gates et al. | 370/252 |
| 8,037,185 | B2 * | 10/2011 | Steinder et al. | 709/226 |
| 8,160,796 | B2 * | 4/2012 | Stempnik et al. | 701/84 |
| 8,171,142 | B2 * | 5/2012 | Kolin et al. | 709/226 |
| 8,200,737 | B2 * | 6/2012 | Tarabzouni et al. | 709/200 |
| 8,359,361 | B2 * | 1/2013 | Thornton et al. | 709/206 |
| 8,769,078 | B2 * | 7/2014 | Pesme et al. | 709/224 |
| 2001/0032031 | A1 * | 10/2001 | Ufheil | 700/169 |
| 2002/0042700 | A1 * | 4/2002 | Giles et al. | 703/6 |
| 2006/0161324 | A1 | 7/2006 | Ozawa et al. | |
| 2007/0226543 | A1 * | 9/2007 | Young et al. | 714/43 |
| 2008/0092849 | A1 | 4/2008 | Mizuguchi | |
| 2008/0167825 | A1 * | 7/2008 | Tarabzouni et al. | 702/36 |
| 2009/0012665 | A1 * | 1/2009 | Brennan et al. | 701/22 |
| 2009/0012882 | A1 * | 1/2009 | Sarangapani et al. | 705/28 |
| 2009/0291491 | A1 * | 11/2009 | Kingsman et al. | 435/320.1 |
| 2009/0294191 | A1 * | 12/2009 | Sheidler et al. | 180/65.31 |
| 2011/0276637 | A1 * | 11/2011 | Thornton et al. | 709/206 |
| 2014/0180571 | A1 * | 6/2014 | Kimchi et al. | 701/409 |

FOREIGN PATENT DOCUMENTS

| | | | | |
|---|---|---|---|---|
| JP | 2000-097056 | A | | 4/2000 |
| WO | WO 03/089723 | A1 | * | 11/2003 |
| WO | WO-2005/042951 | A1 | | 5/2005 |
| WO | WO2005042951 | | * | 5/2005 |
| WO | WO-2006/043619 | A1 | | 4/2006 |

* cited by examiner

| ENG REVOLUTION | 800 | 1530 | 1850 | 1950 | 1950 | 1950 |
|---|---|---|---|---|---|---|
| TORQUE (NET) | 20 | 26.2 | 23.3 | 15.15 | 0 | 0 |

(a) P1 MODE

| ENG REVOLUTION | 800 | 1530 | 1850 | 1950 | 2050 | 2050 |
|---|---|---|---|---|---|---|
| TORQUE (NET) | 20 | 26.2 | 23.3 | 15.15 | 7 | 0 |

(b) P2 MODE

FIG. 4

HYDRAULIC EXCAVATOR

CROSS-REFERENCE TO RELATED APPLICATIONS

This national phase application claims priority to Japanese Patent Application No. 2007-294027, filed on Nov. 13, 2007. The entire disclosure of Japanese Patent Application No. 2007-294027 is hereby incorporated herein by reference.

TECHNICAL FIELD

The present invention relates to a hydraulic excavator including an upper structure equipped with a working unit.

BACKGROUND ART

The construction machines (e.g., hydraulic excavators) have been conventionally used. The construction machines mount an actuator (working unit) including e.g., an arm and a bucket on an upper structure configured to revolve.

For example, Laid-open Japan Patent Publication No. JP-A-2000-097056 (disclosed on Apr. 4, 2000) discloses an engine speed control device. In the engine speed control device, an operation lever is provided with a fuel amount increase switch. The fuel amount increase switch is actuated for increasing the engine speed by increasing the amount of fuel oil in order to solve a drawback of insufficient revolving speed of the upper structure to be cased in simultaneously operating the working unit and the upper structure.

SUMMARY

However, the aforementioned conventional engine speed control device has the following drawback.

In short, the engine speed control device for a construction machine disclosed in the document is configured to execute a control of increasing the engine speed in conjunction with an operation of the fuel amount increase switch when it is required to solve the drawback of insufficient revolving speed of the upper structure. With the configuration, fuel economy can be enhanced because the control of increasing the engine speed is executed only when needed. However, an operator needs to manually operate the fuel amount increase switch when he/she feels insufficient revolving speed. This is annoying for the operator. Additionally, operators differently feel insufficient revolving speed. Therefore, it is difficult to reliably achieve advantageous effects of fuel economy reduction.

An object of the present invention is to provide machine hydraulic excavator for enhancing fuel economy and simultaneously executing an automatic control of solving a drawback of insufficient revolving speed of the upper structure.

A hydraulic excavator according to a first aspect of the present invention is equipped with an engine, a hydraulic pump, a revolving motor and a revolving operation lever. The hydraulic pump is driven by the engine. The revolving motor revolves an upper structure by means of hydraulic oil to be supplied from the hydraulic pump. The revolving operation lever executes an operation of revolving the upper structure. The hydraulic excavator includes an operation amount detection unit and a control unit. The operation amount detection unit is configured to detect an operation amount of the revolving operation lever. The control unit is configured to increase the maximum engine speed when a result of detection by the operation amount detection unit is greater than a predetermined threshold.

According to the first aspect, a control is executed for increasing the maximum engine speed when the revolving operation lever to be used for revolving the upper structure is operated at the operation amount greater than a predetermined threshold.

In this case, the predetermined threshold is set to be a 70-80% or greater operation amount, for instance. A setting of the predetermined threshold can be preferably changed in accordance with operator's preference and a work environment as needed.

With the configuration, the discharge amount of the hydraulic pump to be driven by the engine is increased by increasing the maximum engine speed when an operation of revolving the upper structure mounted on the construction machine is executed at the predetermined amount or greater. Accordingly, it is possible to increase the amount of the hydraulic oil to be supplied to the revolving motor for revolving the upper structure. In other words, a control of increasing the maximum engine speed is executed only when the revolving operation lever is operated at the large amount. Consequently, fuel economy can be enhanced. Simultaneously, regardless of whether or not an operator actually executed an operation, the upper structure can be automatically revolved at the sufficient revolving speed when the sufficient revolving speed is required.

A hydraulic excavator according to a second aspect of the present invention is equipped with an engine, a hydraulic pump, a revolving motor and a revolving operation lever. The hydraulic pump is driven by the engine. The revolving motor revolves an upper structure by means of the hydraulic oil to be supplied from the hydraulic pump. The revolving operation lever executes an operation of revolving the upper structure. The hydraulic excavator includes an operation amount detection unit and a control unit. The operation amount detection unit is configured to detect an operation amount of the revolving operation lever. The control unit is configured to control the engine according to one of two engine torque curves with different maximum engine speeds. The control unit is configured to switch to the engine torque curve with a lower maximum engine speed to the engine torque curve with a higher maximum engine speed when the detection result by the operation amount detection unit is greater than a predetermined threshold under a condition that the engine torque curve with the lower maximum engine speed is being selected.

In the second aspect, the control unit has an engine torque curve that is split towards directions that the engine speed is increased when the engine speed is greater than a predetermined engine speed. When the revolving operation lever to be used for revolving the upper structure is operated at the operation amount that is greater than a predetermined threshold, a control of increasing the engine speed is executed by selecting the engine torque curve that is split towards the direction that the engine speed is increased.

In the second aspect, the aforementioned predetermined threshold is set to be a 70-80% or more operation amount, for instance. A setting of the predetermined threshold can be preferably changed in accordance with operator's preference and a work environment as needed. Additionally, the engine torque curve, which is split into two directions, includes a curve that shifts in a direction that the engine speed is increased when the engine speed is equal to or greater than a predetermined engine speed, for instance.

With the configuration, the maximum engine speed is increased based on the selected engine torque curve when an operation of revolving the upper structure mounted on the construction machine is executed at the predetermined amount or greater. It is thereby possible to increase the amount of the hydraulic oil to be supplied to the revolving motor for revolving the upper structure. In other words, a control of increasing the maximum engine speed is executed only when the revolving operation lever is operated at the large operation amount. Consequently, fuel economy can be enhanced. Simultaneously, regardless of whether or not an operator actually executed an operation, the upper structure can be automatically revolved at the sufficient revolving speed when the sufficient revolving speed is required.

A hydraulic excavator according to a third aspect of the present invention is the hydraulic excavator according to one of the first and second aspects. The control unit is configured to control the engine in one of a power mode and an economy mode. The control unit is also configured to execute a control of increasing the engine speed during the power mode. In the power mode, an output torque of the engine and an absorption torque of the hydraulic pump are matched in a condition that both of the engine speed and the engine output torque are relatively high. In the economy mode, an engine output torque characteristic is set to be lower than that of the power mode.

In the third aspect, the control unit, having so-called P (power) and E (economy) modes, is configured to execute a control of increasing the aforementioned engine speed only during the P mode.

With the configuration, it is possible to execute a control of increasing the maximum engine speed only during the P mode without executing it during the E mode in which the engine speed is inhibited. Consequently, the sufficient revolving speed can be reliably achieved by maintaining a control that a higher priority is placed on fuel economy in the E mode and simultaneously increasing the engine speed in the P mode that a higher priority is placed on operability.

A hydraulic excavator according to a fourth aspect of the present invention is the hydraulic excavator according to one of the first and second aspects. In the engine control device, the control unit is configured to control the engine according to one of a plurality of engine torque curves.

In fourth aspect, the control unit has a plurality of engine torque curves corresponding to a control of increasing the aforementioned engine speed in addition to modes including the power mode, the economy mode and the like.

With the configuration, the aforementioned engine speed control can be easily executed only by providing the corresponding engine torque curves similarly to the power mode and the like. Consequently, the sufficient revolving speed can be reliably achieved by increasing the maximum engine speed while characteristics of the modes are properly utilized.

A hydraulic excavator according to a fifth aspect of the present invention is the hydraulic excavator according to the fourth aspect. In the hydraulic excavator, the control unit is configured to select a prescribed engine torque curve from the plurality of engine torque curves in accordance with the operation amount of the revolving operation lever. The control unit is configured to set an upper limit of the torque on the selected engine torque curve depending on an operation condition of an actuator of the construction machine other than the upper structure.

In the fifth aspect, the control unit, having a plurality of engine torque curves, is configured to select a corresponding engine torque curve in accordance with the operation amount of the revolving operation lever. Further, the control unit sets the upper limit of the absorption torque (plateau torque) depending on an operation condition of the other actuator (e.g., arm) as needed.

With the configuration, the upper structure can be revolved at the sufficient revolving speed in accordance with the operation amount of the revolving operation lever. Simultaneously, reduction in fuel economy can be prevented by setting the upper limit of the absorption torque.

A hydraulic excavator according to a sixth aspect of the present invention is the hydraulic excavator according to one of the first and second aspects. In the hydraulic excavator, the control unit is configured to activate the engine speed control when the operation amount of the revolving operation lever is greater than a first threshold. On the other hands, the control units is configured to deactivate the engine speed control when the operation amount of the revolving operation lever is less than a second threshold that is less than the first threshold.

In the sixth aspect, the first threshold is set for activating the aforementioned engine speed control when the operation amount of the revolving operation lever is greater than the first threshold. Further, the second threshold is set for deactivating the aforementioned engine speed control when the operation amount is less than the second threshold.

Even when the operation amount of the revolving operation lever varies (i.e., increases/decreases), shocks can be reduced in switching controls by executing the engine speed control under the condition that a hysteresis characteristic is produced by setting two thresholds.

A hydraulic excavator according to a seventh aspect of the present invention is the hydraulic excavator for the construction machine according to one of the first and second aspects. In the hydraulic excavator, the hydraulic pump is a revolving standalone pump that supplies hydraulic oil to drive the upper structure.

In the seventh aspect, an engine control is executed for a construction machine equipped with a revolving standalone pump for a revolving motor as a hydraulic pump for providing the hydraulic oil to a revolving motor for revolving the upper structure.

In this case, the revolving standalone pump is a hydraulic pump provided for supplying the hydraulic oil to the revolving motor. The revolving standalone pump does not supply the hydraulic oil to an actuator for driving other components excluding the upper structure.

With the configuration, the revolving standalone pump to be driven by the engine increases its discharge amount in proportion to increase in the engine speed. Therefore, it is possible to reliably ensure the amount of the hydraulic oil that is discharged by the revolving standalone pump and is then supplied to the revolving motor for revolving the upper structure. Consequently, the upper structure can be revolved at the sufficient revolving speed in executing a control of increasing the maximum engine speed.

BRIEF DESCRIPTION OF THE DRAWINGS

FIGS. 4(*a*) and 4(*b*) are tables of points forming engine torque curves in P1 and P2 modes.

DETAILED DESCRIPTION OF THE EMBODIMENTS

The following is an explanation of a hydraulic excavator (construction machine) 1 equipped with an engine control device for a construction machine according to an embodiment of the present invention with reference to FIGS. 1 to 6(*b*).

Configuration of Hydraulic Excavator 1

Figure 1:
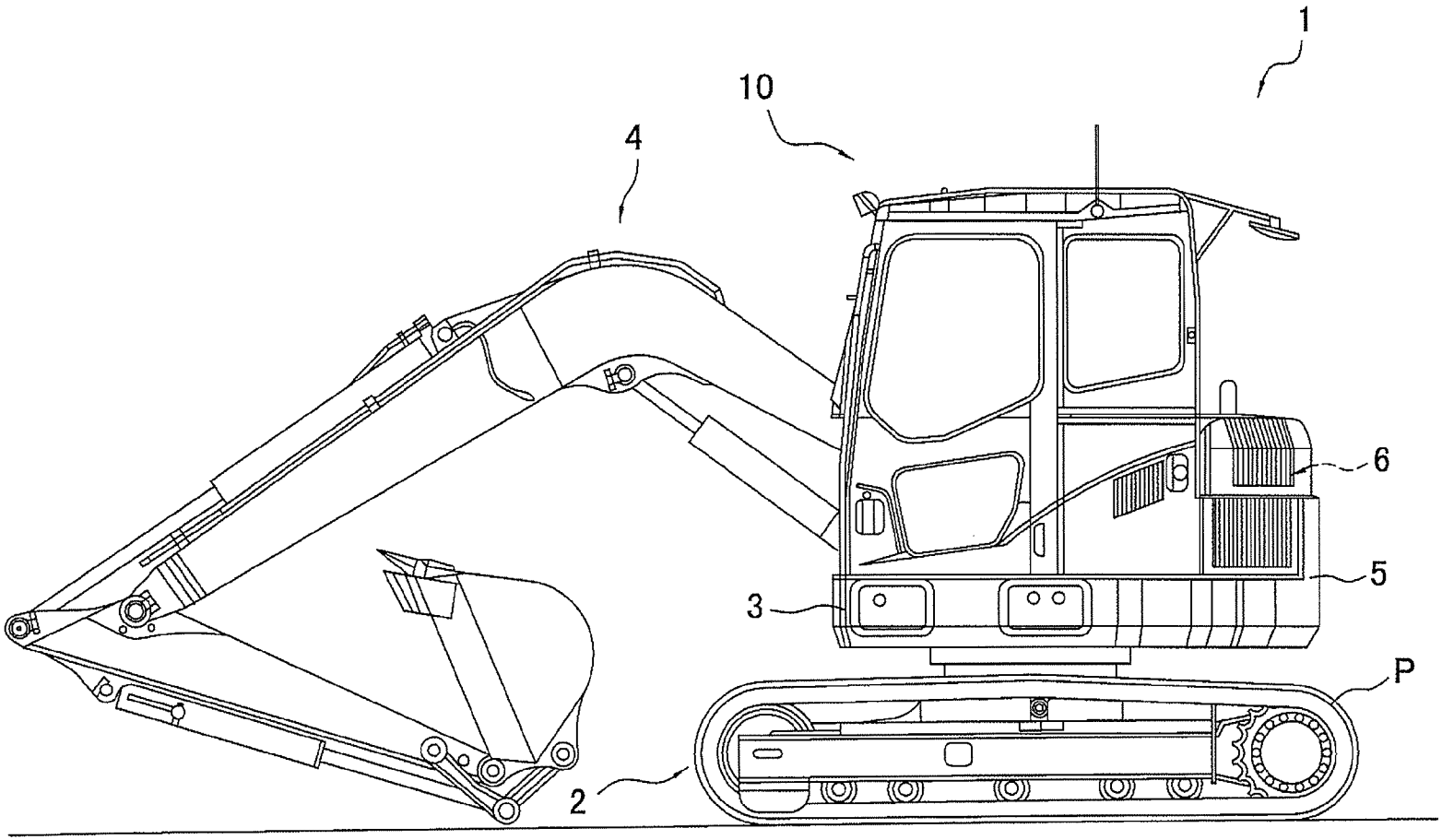
FIG. 1 is a structural side view of a hydraulic excavator equipped with an engine control device according to an embodiment of the present invention.
Figure 2:
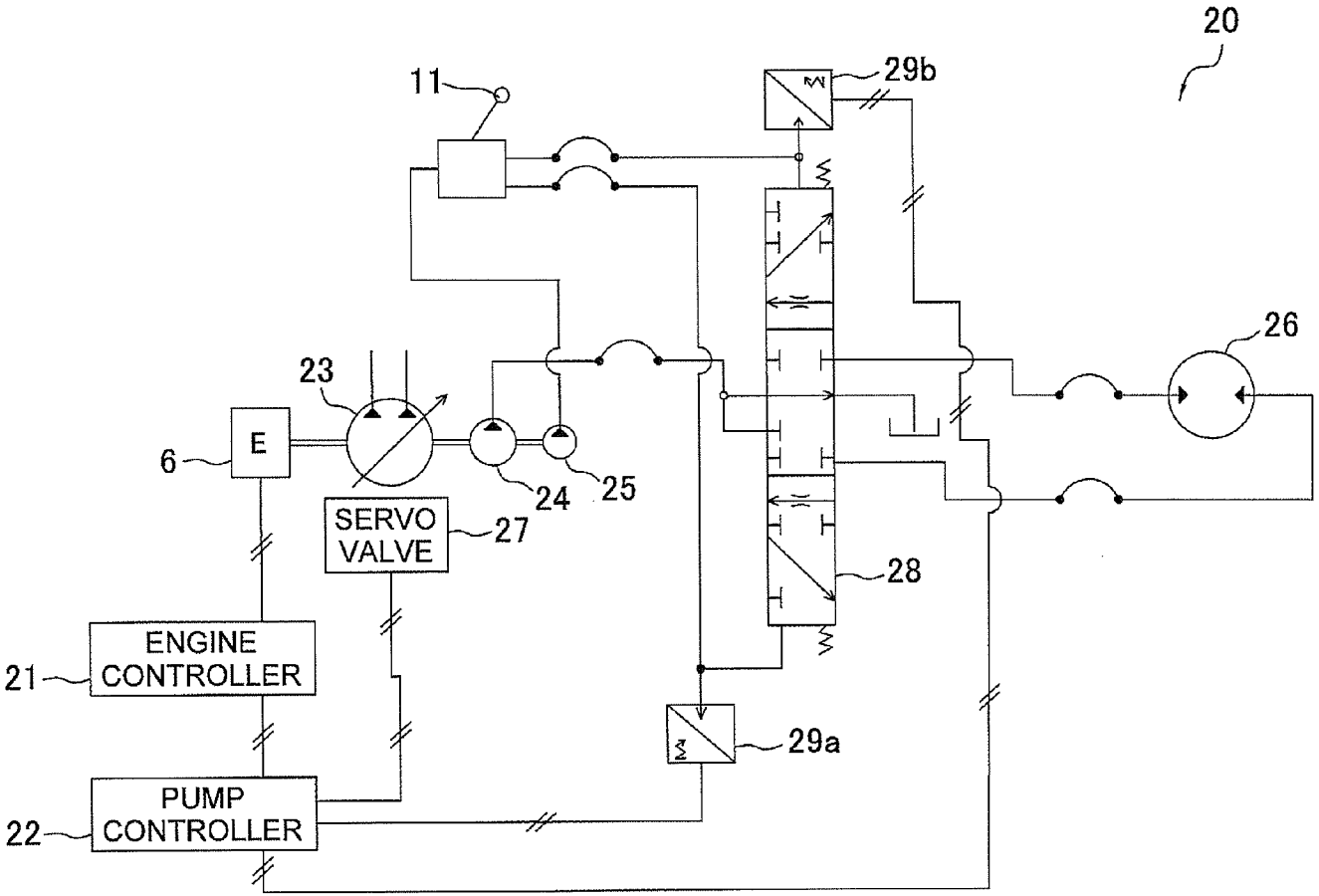
FIG. 2 is a structural circuit diagram of a hydraulic circuit including the engine control device mounted on the hydraulic excavator illustrated in FIG. 1.

As illustrated in FIG. 1, a hydraulic excavator 1 according to the present embodiment is composed of a lower traveling unit 2, an upper structure 3, a working unit 4, a counterweight 5, an engine 6, a cab 10 and an engine control device 20 (see FIG. 2).

The lower traveling unit 2 causes the hydraulic excavator 1 to move forward/rearward by circulating a pair of crawler belts P. The crawler belts P are herein wound around the transverse ends of the lower traveling unit 2 directed to a moving direction. Additionally, the lower traveling unit 2 is equipped with the upper structure 3 on its top side while allowing the upper structure 3 to revolve.

The upper structure 3 is configured to revolve on the lower traveling unit 2 in an arbitrary direction in conjunction with rotation of a pinion gear. The pinion gear meshes with a revolving bearing disposed in the lower traveling unit 2 side. The pinion gear is rotated by means of rotational driving force of a revolving motor 26 (see FIG. 2) to be described. As illustrated in FIG. 1, the upper structure 3 is equipped with the working unit 4, the counterweight 5, the engine 6 and the cab 10 on its top side.

The working unit 4 is mainly made up of a boom, an arm and a bucket. The arm is attached to the tip of the boom. The bucket is attached to the tip of the arm. The working unit 4 executes an excavation work for soil, pebble and the like in a civil engineering work site, while moving up and down the arm, the bucket and the like by means of the hydraulic cylinder.

The counterweight 5 is a weight disposed on the rear part of the upper structure 3 for balancing the vehicle body in executing an excavation work and the like. The inner space of the counterweight 5 is filled with iron scraps, cement and the like.

The engine 6 is a driving source of the hydraulic excavator 1. The engine 6 is disposed on the upper structure 3. Especially, it is disposed behind the cab 10 while being disposed adjacent to the counterweight 5. Actions (e.g., engine speed) of the engine 6 are controlled by the engine control device 20 to be described. Additionally, the engine 6 is coupled to a traveling and working unit variable pump 23 (see FIG. 2) to be described. The discharge amount of the traveling and working unit variable pump 23 is regulated in accordance with increase/decrease of the revolution speed of the engine 6.

The cab 10 is an operator's room that an operator of the hydraulic excavator 1 gets on and off. The cab 10 is disposed on the left-front part on the upper structure 3. Especially, it is disposed lateral to a part where the working unit 4 is attached.

The engine control device 20 is configured to control actions (e.g., engine speed) of the engine 6 mounted on the upper structure 3. The engine control device 20 has a plurality of modes corresponding to a plurality of engine torque curves. Note composition of the engine control device 20 and contents of the modes will be hereinafter explained in detail.

Engine Control Device 20

As illustrated in FIG. 2, the engine control device 20 according to the present embodiment includes the engine 6, a revolving operation lever 11, an engine controller (control unit) 21, a pump control device 22, the traveling and working unit variable pump 23, a revolving fixed pump (hydraulic pump, revolving standalone pump) 24, a pilot fixed pump 25, the revolving motor 26, a servo valve 27, an operation valve 28, a right revolving pilot pressure sensor (operation amount detection unit) 29*a* and a left revolving pilot pressure sensor (operation amount detection unit) 29*b*.

The engine controller 21 controls actions (e.g., engine speed) of the engine 6. The engine 6 drives the traveling and working unit variable pump 23, the revolving fixed pump 24 and the pilot fixed pump 25, which are coupled to an output shaft of the engine 6. In other words, the traveling and working unit variable pump 23, the revolving fixed pump 24 and the pilot fixed pump 25 are driven in conjunction with revolution of the output shaft of the engine 6.

The revolving operation lever 11 is disposed aside of an operator's seat within the cab 10. The pilot pressure (PPC pressure), corresponding to the operation amount by an operator, is sent to a pilot port of the operation valve 28 from a PPC valve that the revolving operation lever 11 is connected. The left and right revolving pilot pressure sensors 29*a*, 29*b* herein detect the PPC pressure, and the detected result is sent to the engine controller 21 via the pump control device 22. Accordingly, the amount of hydraulic oil to be supplied to the revolving motor 26 from the operation valve 28 is regulated depending on the operation amount of the revolving operation lever 11. Then, the engine controller 21 executes an engine speed control to be described based on the operation amount of the revolving operation lever 11.

Figure 3:
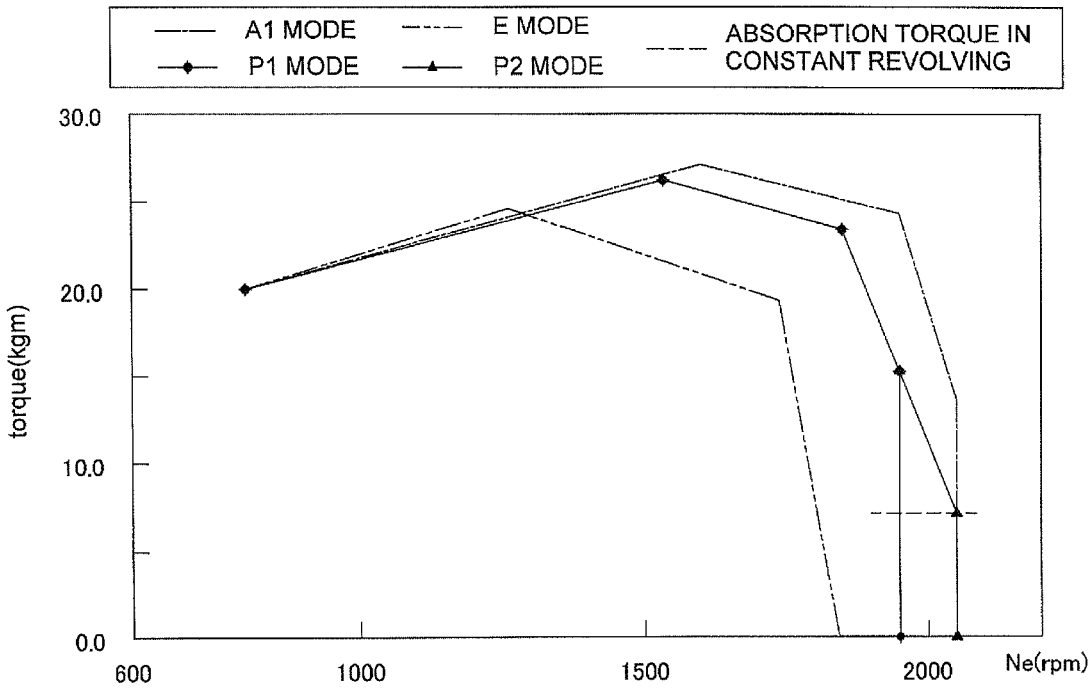
FIG. 3 is a chart of a plurality of engine torque curves that the engine control device of FIG. 2 has.

The engine controller (control unit) 21 outputs a revolution command value to a governor attached to a fuel injection pump of the engine 6 in order to achieve a target engine speed of the engine 6 that drives the traveling and working unit variable pump 23 and the like. Additionally, the engine controller 21 receives electric signals from the left and right revolving pilot pressure sensors 29*a*, 29*b*. The electric signals herein correspond to the operation amount (PPC pressure) of the revolving operation lever 11. Then, the engine controller 21 controls the engine speed of the engine 6 for reliably keeping sufficient revolving speed of the upper structure 3 depending on whether or not the received operation amount of the revolving operation lever 11 is greater than a predetermined threshold. Further, the engine controller 21 has a plurality of control modes corresponding to a plurality of engine torque curves, as shown in FIG. 3. Note contents of the control modes and the engine speed control will be hereinafter explained in detail.

The pump control device 22 is connected to the servo valve 27. The pump control device 22 outputs control current for controlling a tilt angle of a swash plate of the traveling and working unit variable pump 23. Additionally, the pump control device 22 is connected to the engine controller 21 and the left and right revolving pilot pressure sensors 29*a*, 29*b*. The pump control device 22 sends detection results by the left and right revolving pilot pressure sensors 29*a*, 29*b* to the engine controller 21.

The traveling and working unit variable pump 23 is a hydraulic pump coupled to the output shaft of the engine 6. The traveling and working unit variable pump 23 supplies the hydraulic oil to a carrier motor of the lower traveling unit 2 and the hydraulic cylinder of the working unit 4, respectively, while the servo valve 27 regulates the tilt angle of the swash plate.

The revolving fixed pump (revolving standalone pump) 24 is a hydraulic pump exclusively for supplying the hydraulic oil to the revolving motor 26 via the operation valve 28. The revolving fixed pump 24 is coupled to the output shaft of the engine 6. The amount of the hydraulic oil to be discharged by the revolving fixed pump 24 is regulated depending on increase/decrease of revolution speed of the output shaft of the engine 6.

The pilot fixed pump 25 is a hydraulic pump for producing the PPC pressure to be applied to the operation valve 28 in conjunction with an operation of the revolving operation lever 11. The pilot fixed pump 25 is coupled to the output shaft of the engine 6, just the same as the revolving fixed pump 24.

The revolving motor 26 is a driving source for revolving the upper structure 3. When the hydraulic oil, discharged by the revolving fixed pump 24, is supplied to the revolving motor 26 via the operation valve 28, the revolving motor 26 causes the pinion gear, meshing with the revolving bearing disposed in the lower traveling unit 2 side, to rotate with the revolution shaft.

The servo valve 27 is driven by the control current to be outputted by the pump control device 22. The servo valve 27 controls the tilt angle of the swash plate of the traveling and working unit variable pump 23 in accordance with a relations between discharge pressure and capacity of the traveling and working unit variable pump 23 and a pump's absorption torque corresponding to the control current.

The operation valve 28 is configured to supply the hydraulic oil to the revolving motor 26. The operation valve 28 applies the PPC pressure, which is outputted depending on the operation amount and an operation direction of the revolving operation lever 11, to a predetermined pilot port corresponding to each operation of the revolving operation lever 11. With the configuration, an operator can revolve the upper structure 3 (revolving motor 26) towards a desired revolving direction by an operation of the revolving operation lever 11.

Each of the right revolving pilot pressure sensor (operation amount detection unit) 29*a* and the left revolving pilot pressure sensor (operation amount detection unit) 29*b* is connected to the revolving operation lever 11, the pump control device 22 and the operation valve 28. The right and left revolving pilot pressure sensors 29*a*, 29*b* detect the operation amount of the revolving operation lever 11, that is, the revolving speed of the upper structure 3 in a right and left direction. Electric signals, corresponding to the operation amount detected by the left and right revolving pilot pressure sensors 29*a*, 29*b*, are subsequently sent to the engine controller 21 via the pump control device 22.

Contents of Control Mode

In the present embodiment, the engine controller 21 has four modes (i.e., an A1 mode, an E (economy) mode and P (power) modes (P1 and P2 modes)) as shown in FIG. 3. An operator can cause the hydraulic excavator 1 to execute a work by manually/automatically switching to his/her desired control mode depending on a variety of conditions (e.g., work performance and work environment).

The control modes will be hereinafter explained.

The A1 mode is automatically selected only when load acting on the engine 6 is equal to or greater than a predetermined value (e.g., in a high-load state during traveling and an overheat state). Specifically, when the A1 mode is automatically selected in a high-load state, as shown in FIG. 3, the full-horsepower output of the hydraulic excavator 1 can be achieved based on an engine torque curve (see a dashed-dotted line in the figure) having the highest absorption torque with respect to the engine speed in the four modes.

The E mode is a type of mode that engine output is controlled to be less than that in the P modes. In the E mode, good work performance cannot be achieved, but good fuel economy can be achieved instead. Specifically, when the E mode is selected, as shown in FIG. 3, a control is executed based on an engine torque curve (see a dashed double-dotted line in the figure) that the maximum engine speed of the engine 6 is inhibited and the upper limit of the absorption torque with respect to the engine speed is set to be low.

The P1 mode is one of the P modes. The P1 mode is also a general power mode that the engine output therein is greater than that in the E mode. The P1 mode is selected when a higher priority is placed on work performance compared to fuel economy. Specifically, when the P1 mode is selected, as shown in FIG. 3, a control is executed based on an engine torque curve (see a circle-dot curve in the figure) that the maximum engine speed of the engine 6 is greater than that in the E mode and the upper limit of the absorption torque with respect to the engine speed is also greater than that in the E mode. More specifically, the engine torque curve has the settings shown in FIG. 4(*a*): the absorption torque is set to be 20 kg·m at the engine speed of 800 rpm; the absorption torque is set to be 26.2 kg·m at the engine speed of 1530 rpm; the absorption torque is set to be 23.3 kg·m at the engine speed of 1850 rpm; the absorption torque is set to be 15.15 kg·m at the engine speed of 1950 rpm; and the maximum engine speed is set to be 1950 rpm.

The P2 mode is the other of the P modes. When predetermined conditions are satisfied, the maximum engine speed is automatically shifted to be greater than that in the P1 mode on the engine torque curve (see the circle-dot curve in the figure) corresponding to the P1 mode. Specifically, when the predetermined conditions are satisfied and the P2 mode is selected, as shown in FIGS. 3 and 4(*b*), the engine torque curve in the P1 mode is split into two directions for increasing the maximum engine speed from 1950 rpm to 2050 rpm. As shown in FIG. 3, increase in the maximum engine speed can thus reliably achieve the absorption torque 7.0 kg·m in the constant revolving at the maximum engine speed. Therefore, it is possible to ensure the sufficient amount of the hydraulic oil to be discharged to the revolving motor 26 from the revolving fixed pump 24 to be driven in accordance with the output of the engine 6. Accordingly, the upper structure 3 can be revolved at the desired revolving speed. More specifically, as shown in FIG. 4(*b*), the absorption torque amount values in the P2 mode are the same as those in the P1 mode in a range of the engine speed equal to or less than 1950 rpm. However, the absorption torque amount values in the P2 mode will be different from those in the P1 mode in a range of the engine speed greater than 1950 rpm. Consequently, an engine torque curve (see a triangle-dot curve in the figure) is formed where the maximum engine speed is set to be 2050 rpm.

Contents of Engine Speed Control

Figure 5:
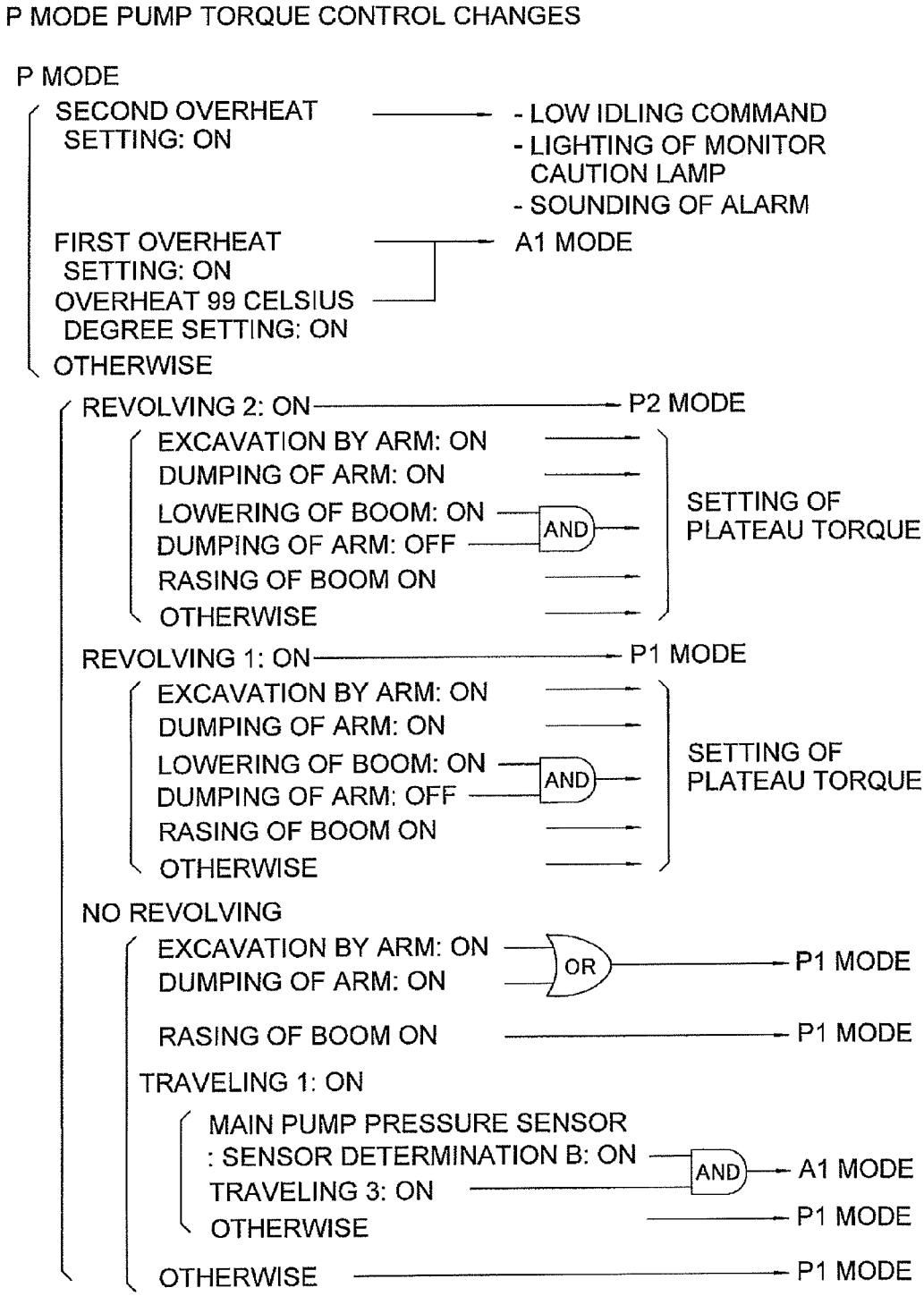
FIG. 5 is a diagram for illustrating an example of control logic to be executed by the engine control device.

In the present embodiment, when predetermined conditions are satisfied (e.g., when the operation amount of the revolving operation lever 11 is equal to or greater than a predetermined amount), the engine controller 21 selects one of the engine torque curves under the control logic shown in FIG. 5 and sets the upper limit of absorption torque (i.e., plateau torque).

The term "predetermined conditions" herein refers to two conditions to be satisfied: one is that the normal P mode (P1 mode) is selected from the aforementioned control modes; and the other is that the operation amount of the revolving operation lever 11 is equal to or greater than a predetermined amount.

Specifically, while the P1 mode is executed, it is firstly determined whether or not a second overheat setting is being turned "ON" under the control logic illustrated in FIG. 5.

When it is herein determined that the second overheat setting is being turned ON, the engine controller 21 outputs a low-idling command to the engine 6. Additionally, a caution lamp is lighted up on a monitor installed in the cab 10, and the P1 mode enters the overheat mode for sounding alarm.

On the other hand, when it is determined that the second overheat setting is being turned "OFF", it is further determined whether or not a first overheat setting is being turned "ON" and simultaneously whether or not a 99 degrees Celsius setting is being turned "ON".

When it is herein determined that the above both settings are being turned "ON", the engine torque curve in the A1 mode is selected, and a matching point of the absorption torque with respect to the engine speed (i.e., plateau torque) is set.

Figure 6:
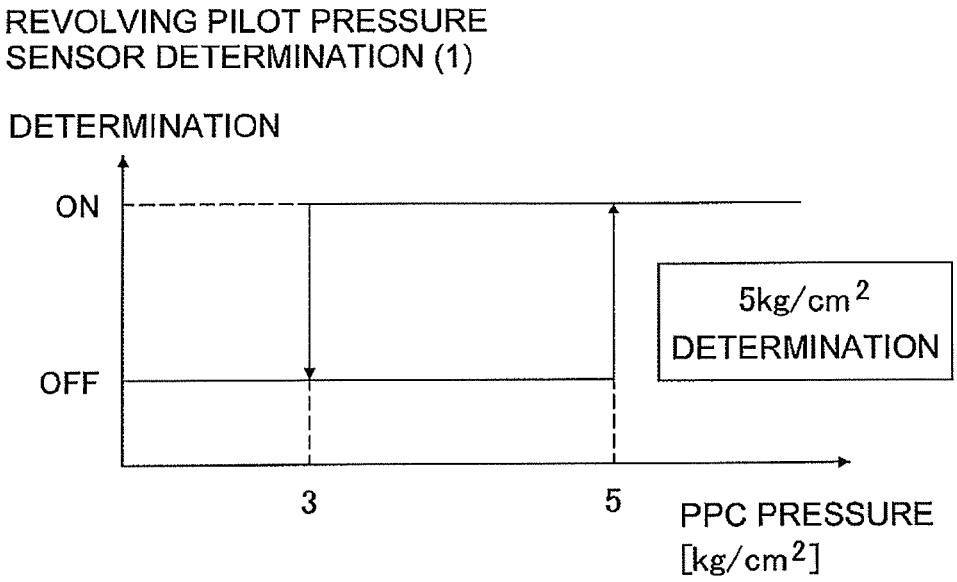
FIGS. 6(*a*) and 6(*b*) are charts of criteria of whether or not an engine speed control is executed based on a result of detection by a revolving pressure sensor.
Figure 6:
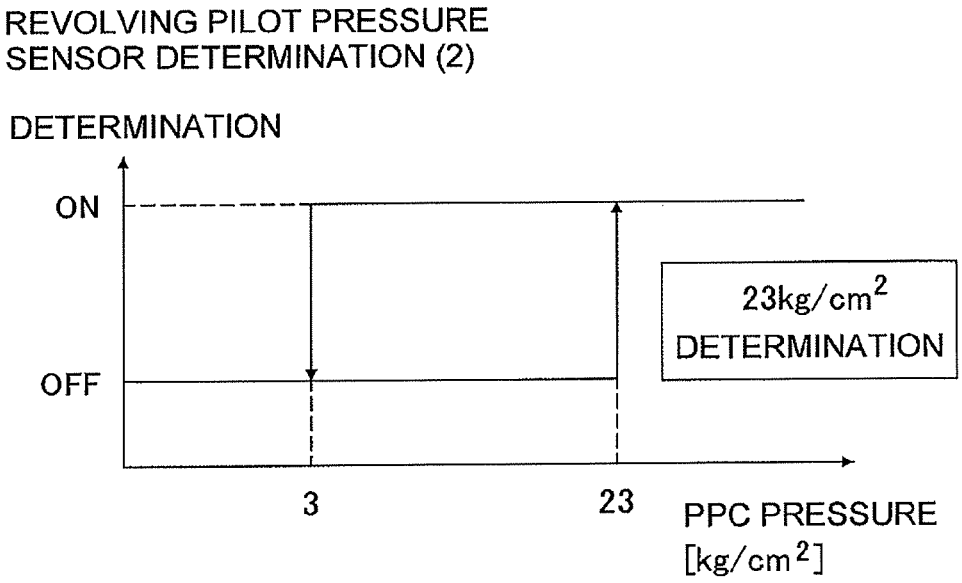

Next, when none of the both conditions are satisfied, a control is executed for selecting an appropriate engine torque curve depending on an extent of the operation amount of the revolving operation lever 11 based on detection results by the left and right revolving pilot pressure sensors 29*a*, 29*b* with reference to charts of FIGS. 6(*a*) and 6(*b*).

In the chart of FIG. 6(*a*), it is specifically determined whether or not a revolving state should be turned into an "ON" state from an "OFF" state depending on whether or not the PPC pressure detected by the left and right revolving pilot pressure sensors 29*a*, 29*b* reaches 5 kg/cm$^2$. On the other hand, when the PPC pressure detected by the left and right revolving pilot pressure sensors 29*a*, 29*b* is reduced to be equal to or less than 3 kg/cm$^2$ after the revolving state is turned into the "ON" state, the revolving state is returned to the "OFF" state. In other words, a determination (1), using the chart of FIG. 6(*a*), is executed to see if the upper structure 3 is revolving in response to an operation of the revolving operation lever 11 under the condition that a threshold of PPC pressure is set to be 5 kg/cm$^2$ for executing the determination.

In the chart of FIG. 6(*b*), on the other hand, it is determined whether or not the revolving state should be turned into the "ON" state from the "OFF" state depending on whether or not the PPC pressure detected by the left and right revolving pilot pressure sensors 29*a*, 29*b* reaches 23 kg/cm$^2$. On the other hand, when the PPC pressure detected by the left and right revolving pilot pressure sensors 29*a*, 29*b* is reduced to be equal to or less than 3 kg/cm$^2$ after the revolving state is turned into the "ON" state, the revolving state is returned to the "OFF" state. In other words, a determination (2), using the chart of FIG. 6(*b*), is executed to see if the upper structure 3 is revolving in response to the operation amount of the revolving operation lever 11 equal to or greater than a predetermined amount (herein roughly 70%) under the condition that a threshold of PPC pressure is set to be 23 kg/cm$^2$ for executing the determination.

A hysteresis characteristic is thus produced by setting two thresholds (i.e., lower and higher thresholds) for each of the determinations (1) and (2). With the hysteresis characteristic, switching controls from the revolving "OFF" state to the revolving "On" state and vice versa can reduce shocks on the vehicle body that are normally caused in executing a switching control.

In the present embodiment, the determination (2) is firstly executed, which corresponds to the chart of FIG. 6(*b*) having a higher threshold (23 kg/cm$^2$) greater than that in FIG. 6(*a*).

In the determination (2), when the detected PPC pressure is herein greater than a predetermined threshold (23 kg/cm$^2$), in other words, when the operation amount of the revolving operation lever 11 is equal to or greater than a predetermined amount, the revolving state is turned into the "ON" state and the P2 mode is selected wherein the maximum engine speed of the engine 6 is higher than that in the P1 mode, as shown in FIG. 5. Then, the plateau torque (upper limit of the absorption torque) is set on the engine torque curve corresponding to the P2 mode as needed, while a work condition of the working unit 4 (e.g., arm and boom) is checked. It is thereby possible to select the P2 mode in such a condition that the operation amount of the revolving operation lever 11 by an operator is equal to or greater than a predetermined amount and relatively light load acts on the engine 6. Accordingly, the maximum engine speed of the engine 6 is shifted from 1950 rpm to 2050 rpm. Consequently, the sufficient revolving speed can be reliably achieved by ensuring the sufficient amount of the hydraulic oil to be supplied to the revolving motor 26.

Next, when the revolving determination (2) determines that the revolving state is on the "OFF" state, the determination (1) will be executed using the chart of FIG. 6(*a*).

When the detected PPC pressure is greater than a predetermined threshold (5 kg/cm$^2$) in the determination (1), the revolving state is turned into the "ON" state. As shown in FIG. 5, the normal power mode (P1 mode) is maintained. Then, the plateau torque (upper limit of absorption torque) is set on the engine torque curve corresponding to the P1 mode as needed, while a work condition of the working unit 4 (e.g., arm and boom) is checked.

Finally, when both of the determinations (1) and (2) determine that the revolving state is on the "OFF" state, it is determined that the upper structure 3 is not revolving. As shown in FIG. 5, the P1 mode is maintained depending on an operation condition of the working unit 4 (e.g., arm and boom) as needed. Here, the A1 mode is selected and a full-horsepower control is executed in a vehicle-moving heavy-load condition where the hydraulic excavator 1 is moving and a value of a pressure sensor of a main pump (traveling and working unit variable pump 23) is equal to or greater than a predetermined value.

Characteristics of Engine Control Device 20

(1) In the engine control device 20 of the hydraulic excavator 1 of the present embodiment, the engine controller 21 checks the operation amount of the revolving operation lever 11 based on a detection result by the left and right revolving pilot pressure sensors 29*a*, 29*b* for executing a engine speed control of the engine 6 of the hydraulic excavator 1 equipped with the upper structure 3, as shown in FIGS. 2 and 3. When the detection result is greater than a predetermined threshold, a control is executed for increasing the maximum engine speed of the engine 6.

Therefore, when an operator expresses his/her intention to quickly revolving the upper structure 3 by operating the revolving operation lever 11 at the predetermined amount or greater, the sufficient amount of the pressure oil can be supplied to the revolving motor 26 by increasing the upper limit of the engine speed of the engine 6 that drives the revolving fixed pump 24 for providing the hydraulic oil to the revolving motor 26. Consequently, reduction in fuel economy can be avoided and simultaneously the upper structure 3 can be revolved at the high speed in response to the operator's intension by increasing the maximum engine speed of the engine 6 at an appropriate timing in a short period of time.

(2) As illustrated in FIG. 3, the engine control device 20 of the hydraulic excavator 1 of the present embodiment has a plurality of engine torque curves including the P1 and P2 modes for executing the aforementioned engine speed control. In the P2 mode, when the engine speed is greater than the predetermined engine speed, the engine torque curve is configured to be split from the engine torque curve in the P1 mode towards the direction that the maximum engine speed is increased. As illustrated in FIG. 2, the engine control device 20 checks the operation amount of the revolving operation lever 11 based on the detection result by the left and right revolving pilot pressure sensors 29*a*, 29*b*. When the detection result is greater than a predetermined threshold, the engine control device 20 executes a control of selecting the P2 mode that the maximum engine speed of the engine 6 is increased.

With the configuration, the engine torque curve is selected for increasing the upper limit of the engine speed of the engine 6 that drives the revolving fixed pump 24 for providing the hydraulic oil to the revolving motor 26, when an operator expresses his/her intention to quickly revolve the upper structure 3 by operating the revolving operation lever 11 at the predetermined amount or greater. Accordingly, the sufficient amount of the hydraulic oil can be supplied to the revolving motor 26. Consequently, reduction in fuel economy can be avoided and simultaneously the upper structure 3 can be revolved at the high speed in response to the operator's intension by increasing the maximum engine speed of the engine 6 at an appropriate timing in a short period of time.

(3) As shown in FIG. 3, the engine control device 20 of the hydraulic excavator 1 of the present embodiment has the E mode and the P modes (i.e., P1 and P2 modes). In the E mode, a higher priority is placed on fuel efficiency than work performance. In the P modes, on the other hand, a higher priority is placed on work performance than fuel efficient.

Accordingly, the aforementioned engine speed control can be executed only in the P modes, for instance, in the engine control including a plurality of control modes. Consequently, it is possible to avoid executing a control of declining fuel economy. Simultaneously, the upper structure 3 can be revolved at the high speed only in the P modes that a higher priority is placed on work performance.

(4) As shown in FIG. 3, the engine control device 20 of the hydraulic excavator 1 of the present embodiment has a plurality of engine torque curves corresponding to the modes.

With the configuration, when the aforementioned engine speed control is executed, only required is to select the engine torque curve for increasing the maximum engine speed of the engine 6 based on the detection result by the left and right revolving pilot pressure sensors 29*a*, 29*b*. In other words, a control can be easier in controlling the engine speed.

(5) As shown in FIG. 5, in the engine control device 20 of the hydraulic excavator 1 of the present embodiment, the upper limit of the absorption torque (plateau torque) is set in accordance with operation conditions of the other actuators (e.g., working unit 4) after the P1 mode or the P2 mode is selected in accordance with the operation amount of the revolving operation lever 11.

Accordingly, reduction in fuel economy can be avoided by setting the upper limit of the absorption torque. Simultaneously, sufficient revolving speed of the upper structure 3 can be reliably achieved.

(6) As shown in FIG. 6(*b*), the engine control device 20 of the hydraulic excavator 1 of the present embodiment executes a determination of revolving "ON"/"OFF" by setting two thresholds (3 kg/cm$^2$ for lower threshold and 23 kg/cm$^2$ for upper threshold) in executing the aforementioned engine speed control.

With the configuration, controls can be switched in the activation of the engine speed control and the deactivation thereof under the condition that a hysteresis characteristic is produced. Accordingly, shocks on the vehicle body can be reduced in switching the controls.

(7) In the engine control device 20 of the hydraulic excavator 1 of the present embodiment, the revolving fixed pump 24 is used as a hydraulic pump for supplying the hydraulic oil to the revolving motor 26 that revolves the upper structure 3, as shown in FIG. 2.

The revolving fixed pump 24, installed in the relatively small hydraulic shove 1, is therefore driven in accordance with the engine speed of the engine 6. In other words, the revolving fixed pump 24 cannot regulate its discharge amount. However, the discharge amount of the revolving fixed pump 24 can be increased in response to increase in the maximum engine speed of the engine 6 through the execution of the aforementioned engine speed control. Consequently, when predetermined conditions are satisfied, the upper structure 3 can be revolved at the sufficient revolving speed by increasing the amount of the hydraulic oil to be supplied to the revolving motor 26.

Other Embodiments

An embodiment of the present invention has been explained above. However, the present invention is not limited to the aforementioned embodiment. A variety of changes can be made for the aforementioned embodiment without departing the scope of the present invention.

(A) The aforementioned embodiment has exemplified that the operation amount of the revolving operation lever 11 is indirectly detected by causing the left and right revolving pilot pressure sensors 29*a*, 29*b* to detect the PPC pressure of the hydraulic oil to be outputted from the PPC valve depending on the operation amount of the revolving operation lever 11. However, the present invention is not limited to the configuration.

For example, a lever operation amount detection unit may be separately provided for directly detecting the operation amount of the revolving operation lever 11.

Even in this case, the sufficient revolving speed can be reliably achieved in a light load condition by executing the aforementioned engine speed control depending on a detection result by the lever operation amount detection unit.

(B) The aforementioned embodiment has exemplified that the control unit has four modes, that is, the A1, E, P1 and P2 modes. However, the present invention is not limited to the configuration.

For example, contents of software for engine control may be changed, and the engine control device may be accordingly configured to execute a control while switching back and forth three or fewer modes or five or more modes.

(C) The aforementioned embodiment has exemplified that the engine controller 21 for controlling the engine 6 and the pump control device 22 for controlling the traveling and working unit variable pump 23 are separately provided. However, the present invention is not limited to the configuration.

For example, a single control device may be configured to control both of the engine and the hydraulic pump.

(D) The aforementioned embodiment has exemplified that the aforementioned engine speed control is executed using the PPC pressure of 23 kg/cm$^2$ as a threshold for determining whether or not a control is activated (note the PPC pressure of 23 kg/cm$^2$ corresponds to roughly 70% operation amount of the revolving operation lever). However, the present invention is not limited to the configuration.

The threshold for executing the engine speed control, that is, the PPC pressure corresponding to the operation amount of the revolving operation lever, is not limited to 23 kg/cm$^2$. For example, the PPC pressure may be set to be equal to or greater than 25 kg/cm$^2$, or set to be less than 20 kg/cm$^2$.

It should be noted that the object of the aforementioned engine speed control is to reliably achieve the sufficient revolving speed of the upper structure. In view of the object, the operation amount of the revolving operation lever, which is equal to or greater than the considerable operation amount, should be set as a condition for determining whether or not the control is activated. Therefore, the threshold is desirably set to be the PPC pressure at least corresponding to 60% or more operation amount.

Further, it is possible to provide a construction machine with better operability by regulating the magnitude of the threshold depending on operator's preference.

(E) In the aforementioned embodiment, the hydraulic excavator 1 has been exemplified as a construction machine equipped with the engine control device 20 of the present invention. However, the present invention is not limited to the example.

For example, the present invention can be similarly applied to the construction machines equipped with an upper structure (e.g., crawler cranes and track cranes).

The hydraulic excavator of the illustrated embodiment achieves an advantageous effect of enhancing fuel economy and simultaneously achieves an advantageous effect of automatically executing a control of solving a problem of an insufficient revolving speed of the upper structure. Therefore, the engine control device can be widely applied to a variety of construction machines provided with the upper structure.

The invention claimed is:

1. A hydraulic excavator comprising:

an engine;

a hydraulic pump to be driven by the engine;

a lower traveling unit configured to move the hydraulic excavator;

an upper structure on which a cab is mounted, the upper structure being revolvably arranged over the lower traveling unit;

a revolving motor for revolving the upper structure with respect to the lower traveling unit by means of hydraulic oil to be supplied from the hydraulic pump;

a revolving operation lever for executing an operation of revolving the upper structure along with the cab over the lower traveling unit;

an operation amount detection unit configured to detect an operation amount of the revolving operation lever, the operation amount of the revolving operation lever being indicative of an amount of hydraulic oil to be supplied to the revolving motor for revolving the upper structure with respect to the lower traveling unit; and a control unit configured to control the engine according to one of two engine torque curves with different maximum engine speeds, and to switch to the engine torque curve with a higher maximum engine speed when the detection result by the operation amount detection unit is greater than a first threshold under a condition that the engine torque curve with the lower maximum engine speed is being selected, the first threshold corresponding to 60% or more operation amount of the revolving operation lever, the control unit being further configured to switch from the engine torque curve with the higher maximum engine speed to the engine torque curve with the lower maximum engine speed when the operation amount of the revolving operation lever becomes less than a second threshold after having been greater than the first threshold, the second threshold being greater than zero and less than the first threshold.

2. A hydraulic excavator comprising:

an engine;

a hydraulic pump to be driven by the engine;

a lower traveling unit configured to move the hydraulic excavator;

an upper structure on which a cab is mounted, the upper structure being revolvably arranged over the lower traveling unit;

a revolving motor for revolving the upper structure with respect to the lower traveling unit by means of hydraulic oil to be supplied from the hydraulic pump;

a revolving operation lever for executing an operation of revolving the upper structure along with the cab over the lower traveling unit;

an operation amount detection unit configured to detect an operation amount of the revolving operation lever, the operation amount of the revolving operation lever being indicative of an amount of hydraulic oil to be supplied to the revolving motor for revolving the upper structure with respect to the lower traveling unit; and a control unit configured execute an engine speed control to increase an upper limit engine speed when the operation amount of the revolving operation lever detected by the operation amount detection unit is greater than a first threshold corresponding to a 60% or more operation amount of the revolving operation lever, the control unit being further configured to deactivate the engine speed control when the operation amount of the revolving operation lever is less than a second threshold, the second threshold being greater than zero and less than the first threshold.

3. The hydraulic excavator according to claim 2, wherein the control unit is configured to control the engine in one of a power mode in which an output torque of the engine and an absorption torque of the hydraulic pump are matched in a condition that both of the engine speed and the engine output torque are relatively high; and an economy mode in which an engine output torque characteristic is set to be lower than that of the power mode, and the control unit is configured to execute a control of increasing the engine speed during the power mode.

4. The hydraulic excavator according to claim 2, wherein the control unit is configured to control the engine according to one of a plurality of engine torque curves.

5. The hydraulic excavator according to claim 4, wherein the control unit is configured to select a prescribed engine torque curve from said plurality of engine torque curves in accordance with the operation amount of the revolving operation lever, and the control unit is configured to set an upper limit of the torque on the selected engine torque curve depending on an operation condition of an actuator of the construction machine other than the upper structure.

6. A hydraulic excavator comprising:

an engine;

a hydraulic pump to be driven by the engine, the hydraulic pump being a revolving standalone pump that supplies hydraulic oil to drive the upper structure;

a lower traveling unit configured to move the hydraulic excavator;

an upper structure on which a cab is mounted, the upper structure being revolvably arranged over the lower traveling unit;

a revolving motor for revolving the upper structure with respect to the lower traveling unit by means of hydraulic oil to be supplied from the hydraulic pump;

a revolving operation lever for executing an operation of revolving the upper structure along with the cab over the lower traveling unit;

an operation amount detection unit configured to detect an operation amount of the revolving operation lever, the operation amount of the revolving operation lever being indicative of an amount of hydraulic oil to be supplied to the revolving motor for revolving the upper structure with respect to the lower traveling unit; and a control unit configured to increase an upper limit engine speed when the operation amount of the revolving operation lever detected by the operation amount detection unit is greater than a predetermined operation amount threshold corresponding to 60% or more operation amount of the revolving operation lever.

7. The hydraulic excavator according to claim 6, wherein the control unit is configured to control the engine in one of a power mode in which an output torque of the engine and an absorption torque of the hydraulic pump are matched in a condition that both of the engine speed and the engine output torque are relatively high; and an economy mode in which an engine output torque characteristic is set to be lower than that of the power mode, and the control unit is configured to execute a control of increasing the engine speed during the power mode.

8. The hydraulic excavator according to claim 6, wherein the control unit is configured to control the engine according to one of a plurality of engine torque curves.

9. The hydraulic excavator according to claim 8, wherein the control unit is configured to select a prescribed engine torque curve from said plurality of engine torque curves in accordance with the operation amount of the revolving operation lever, and the control unit is configured to set an upper limit of the torque on the selected engine torque curve depending on an operation condition of an actuator of the construction machine other than the upper structure.

10. A hydraulic excavator comprising:

an engine;

a hydraulic pump to be driven by the engine, the hydraulic pump being a revolving standalone pump that supplies hydraulic oil to drive the upper structure;

a lower traveling unit configured to move the hydraulic excavator;

an upper structure on which a cab is mounted, the upper structure being revolvably arranged over the lower traveling unit;

a revolving motor for revolving the upper structure with respect to the lower traveling unit by means of hydraulic oil to be supplied from the hydraulic pump;

a revolving operation lever for executing an operation of revolving the upper structure along with the cab over the lower traveling unit;

an operation amount detection unit configured to detect an operation amount of the revolving operation lever, the operation amount of the revolving operation lever being indicative of an amount of hydraulic oil to be supplied to the revolving motor for revolving the upper structure with respect to the lower traveling unit; and a control unit configured to control the engine according to one of two engine torque curves with different maximum engine speeds, and to switch to the engine torque curve with a higher maximum engine speed when the detection result by the operation amount detection unit is greater than a first threshold under a condition that the engine torque curve with the lower maximum engine speed is being selected, the first threshold corresponding to 60% or more operation amount of the revolving operation lever.

* * * * *